US005454283A

United States Patent [19]

Stefano

[11] Patent Number: 5,454,283

[45] Date of Patent: Oct. 3, 1995

[54] RATCHET LINE WRENCH TOOL

[76] Inventor: Jerry D. Stefano, 18 Lincoln Ave., Islip Terrace, N.Y. 11752

[21] Appl. No.: 286,093

[22] Filed: Aug. 4, 1994

Related U.S. Application Data

[63] Continuation-in-part of Ser. No. 999,735, Dec. 21, 1992, abandoned, and a continuation-in-part of Ser. No. 765,301, Sep. 25, 1991, abandoned.

[51] Int. Cl.[6] ..... B25B 13/46

[52] U.S. Cl. ..... 81/58.2; 81/60

[58] Field of Search ..... 81/58.2, 60–63.2

[56] References Cited

U.S. PATENT DOCUMENTS

| | | | |
|---|---|---|---|
| 666,202 | 1/1901 | Lord | 81/60 |
| 972,627 | 10/1910 | Lawson | 81/58.2 X |
| 1,890,213 | 3/1931 | Cameron et al. | 81/58.2 X |
| 2,376,575 | 5/1945 | Cronan | 81/58.2 X |
| 2,456,838 | 12/1948 | Peterson et al. | 81/58.2 |
| 2,521,419 | 9/1950 | Sellers | 81/58.2 X |
| 2,954,715 | 10/1960 | Wycech | 81/58.2 X |
| 3,535,960 | 10/1970 | Borries | 81/58.2 X |

FOREIGN PATENT DOCUMENTS

| | | | |
|---|---|---|---|
| 2817784 | 10/1979 | Germany | 81/58.2 |

*Primary Examiner*—D. S. Meislin
*Attorney, Agent, or Firm*—Alfred M. Walker

[57] ABSTRACT

A ratchet line wrench tool has generally C-shaped housing with a hollow portion for receiving a line fitting nut, said hollow portion defined by an inner ratchet gear within said housing, said catcher gear engageable by reciprocating teeth with teeth of a dog gear held in place by a biasing spring within the interior walls of said housing. The ratchet gear allows the wrench to click backward and to resume the tightening or loosening of a line fitting nut on the forward stroke of the wrench.

1 Claim, 2 Drawing Sheets

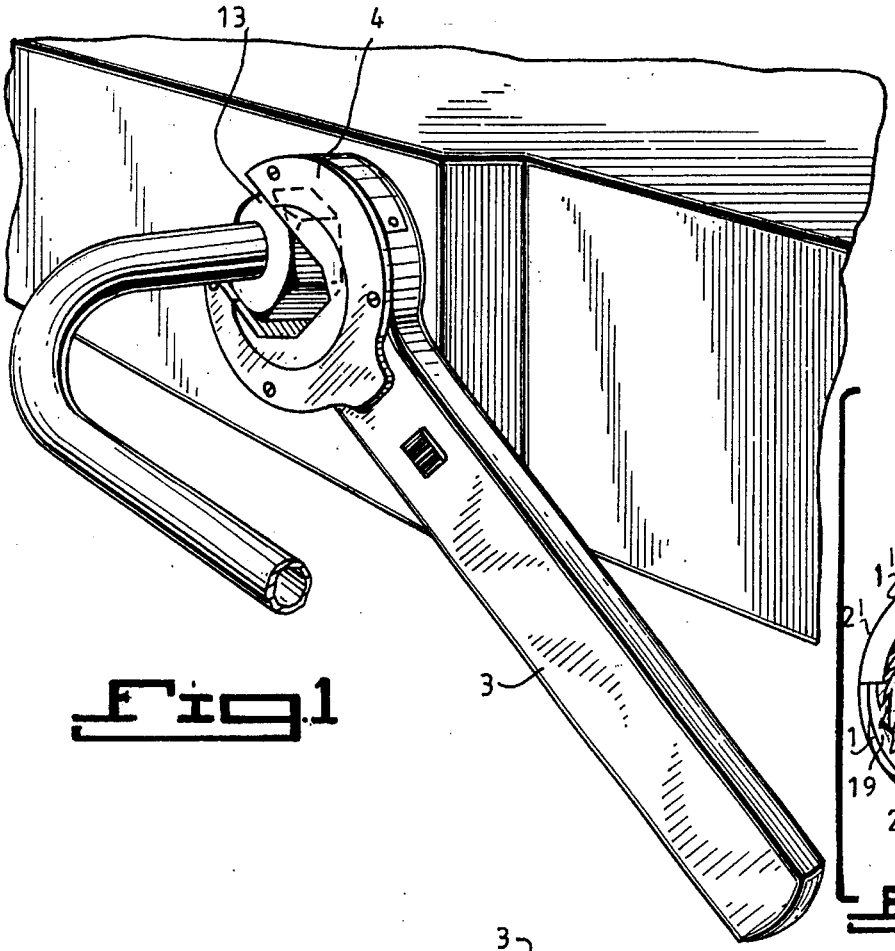
Fig.1
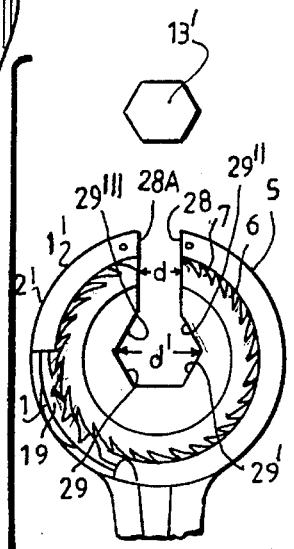
Fig.3A
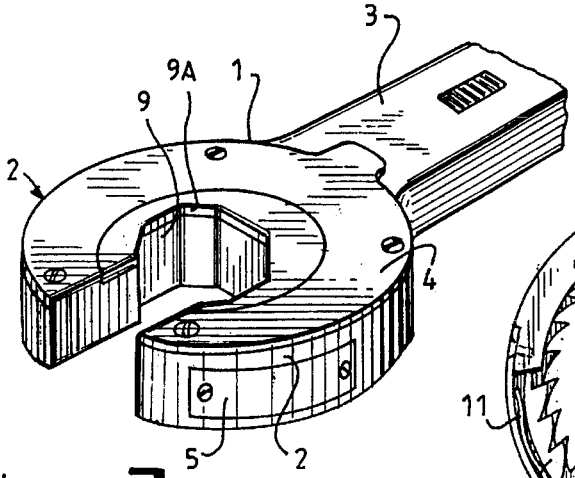
Fig.2
Fig.3
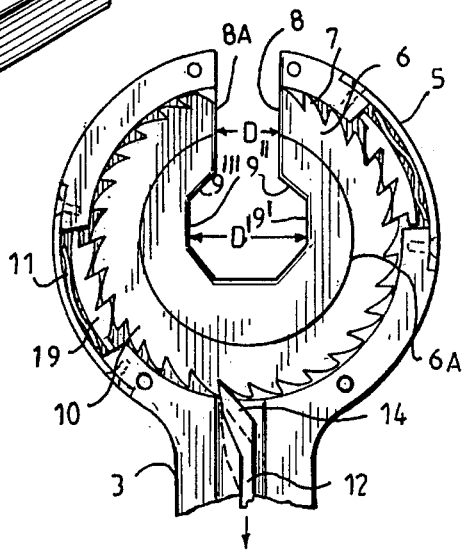

RATCHET LINE WRENCH TOOL

This application is a continuation-in-part of application Ser. No. 07/999,735, filed Dec. 21, 1992 and a continuation-in-part of application Ser. No. 07/765,301 filed Sep. 25, 1991 both abandoned.

The present invention relates to a ratchet line wrench tool, more particularly to a wrench which is provided with an interior ratchet gear and pivot lock enclosed within the wrench.

BACKGROUND OF THE INVENTION

Ratchet wrenches of the general type are known in the art. Some of the cutting elements are disclosed for example in Thompson, U.S. Pat. No. 2,659,257; Hermanson, U.S. Pat. No. 2,700,315; Bailey U.S. Pat. No. 4,488,459; Shirley, U.S. Pat. No. 4,622,870; and Bailey, U.S. Pat. No. 4,644,830. The ratchet wrenches disclosed in these references have different constructions.

For example, Thompson '257 and Hermonson '315 require the use of multiple, internal coil springs which are complicated to install and subject to frequent breakage. Bailey '459 includes multiple, individual pawls to operate and adjustment of the Shirley '870 patent requires separate application of manual force upon a coupler in combination with a leaf spring.

It is to be understood that the wrenches can be further improved as to their construction and use. The aforementioned references do not disclose a ratchet wrench for line fittings where the wrench can be turned over without separately actuating a directional turn device for turning the direction of the ratchet tool.

The instant invention only has to be placed on a line fitting once. Unlike other wrenches, which have to be placed on and off the line fitting until the line fitting is loose, the instant invention can be used in place after installation once.

SUMMARY OF THE INVENTION

The ratchet line wrench tool is designed for use on tubing fittings. Such fittings require simple open end wrenches, or special box wrenches which have been cut away to slip over the tubing. Box wrenches are always preferred because they do not round over the corners of a hexagonal nut. The present invention incorporates the added feature of a ratchet arrangement to the special box wrench. Unlike to cutaway box wrench, the ratchet line wrench tool need not be slipped back from the nut, rotated backwards, and re-engaged back over the hexagonal nut to make another partial turn of the nut.

The addition of the ratchet gear allows the wrench to click backward and to resume the tightening or loosening of the fitting nut on the forward stroke of the use of the wrench.

OBJECTS OF THE INVENTION

Accordingly, it is an object of the present invention to provide a ratchet line wrench tool that holds in place without having to adjust and readjust the hold of the ratchet upon the line fitting for each stroke of the tightening of the wrench upon the nut of the fitting.

Furthermore, it is an object of the present invention to provide a ratchet line wrench tool which extends slidably over a line with a fitting, which tool has a gear, which gear is held in place while the wrench is being used by tightening strokes.

More particularly, it is an object of the present invention to provide a ratchet line wrench tool by means of interlocking gears movable within the housing head portion of the wrench which permits the easy, expeditious and accurate tightening of a line fitting to exact user specifications for a given task of tightening.

It is a further object of the invention to provide a stable holding spring which locks the ratchet gear in place to a reciprocal dog gear.

It is a further object of the invention to provide a simple tooth repositioning pivot lock to move the position of the ratchet line wrench tool gear.

It is a further object of the invention to provide a sturdy wrench tool which is simple in installation and sturdy in construction.

In keeping with these objects and with others which will become apparent hereinafter, one feature of the present invention resides, briefly stated, in a ratchet line wrench tool which has a fitting housing portion for engagement over a line fitting such as a nut, which housing portion contains a slidable ratchet gear having a cutaway interior portion defined by two converging segments of the ratchet gear, forming a substantially rounded U-shaped configuration, which gear holds a nut or other fitting in place when in use, but which gear is slidable during the period of nontightening by a sliding around a dog gear portion having reciprocal teeth, which dog gear is held in place by a spring, to keep pressure on the dog gear and hold the ratchet gear in place around a nut or fitting to be tightened. The opening of the ratchet gear defines an inner hollow portion around the fitting to be tightened.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a perspective view of a ratchet line wrench tool in accordance with the present invention.

FIG. 2 is a close-up perspective view showing the housing tightening portion of the invention.

FIGS. 3 and 3A are a top, cutaway view in partial sections showing the ratchet gear in place within the housing shown in FIGS. 1 and 2.

DESCRIPTION OF THE PREFERRED EMBODIMENT

Figure 4:
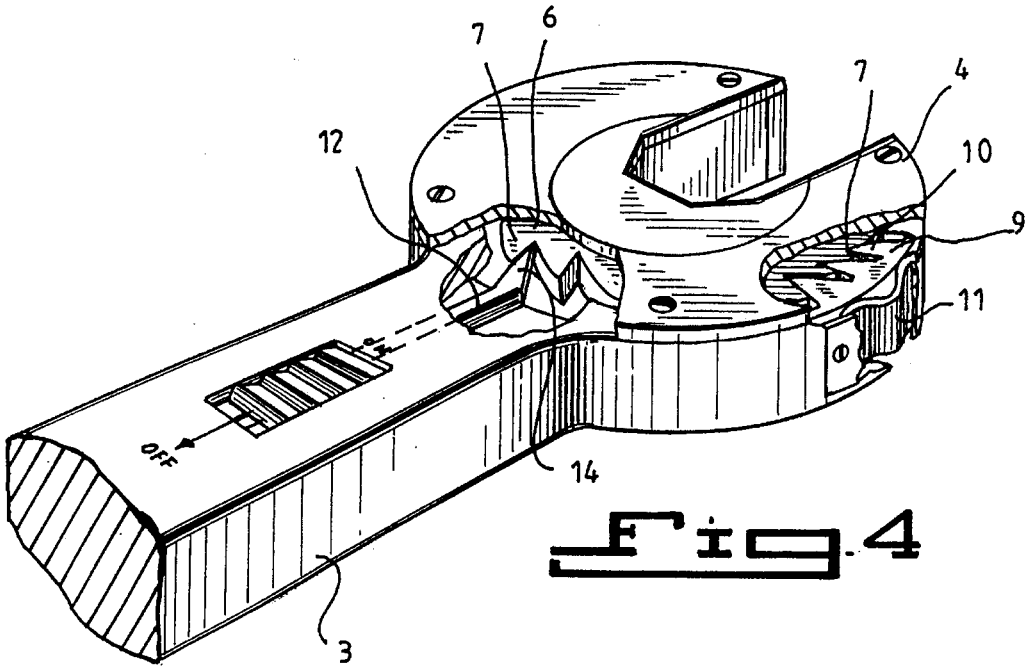
FIG. 4 is a perspective view in partial section of the ratchet line wrench tool in accordance with the invention.

The ratchet line wrench tool 1 in accordance with the present invention has a housing which is identified as a whole with a reference numeral 2.

As can be seen from FIGS. 2 and 3, the housing 2 is operated by mechanical strokes by force applied to handle 3. The housing 2 has a removable plate cover 4 which encloses the generally U-shaped ratchet gear 6 having teeth 7 reciprocally engageable with non-rotatable dog gear 19 having interlocking teeth 10. The dog gear 19 is held in place by a spring 11, generally steel, which keeps pressure upon the dog gear 19 engageable with and contacting adjacent against the ratchet gear 6. The ratchet gear has opening surface portions 8 and 8a as well as a hollow inner portion defined by a multi-faced wall 9 reciprocating the exterior shape of a nut or line fitting. The ratchet gear 6 has teeth 7 which are engageable with the dog gear element 9 having teeth 10, which dog gear is held in place by spring 11 biased against subplate 5 of wrench housing 2.

Ratchet gear 6 has upward extending generally C-shaped protrusion member 6A, such that the axis of protrusion member 6A is perpendicular to the top plane surface of ratchet gear 6. The protrusion member extends up to the top level of housing 2, and the opening of the protrusion member conforms to the opening in housing 2.

The inner, upward extending walls 9A of protrusion member 6A are flush to and conform to the multi-faced inner wall 9 of ratchet gear 6 when ratchet gear 6 engages nut or fitting 13. The rounded, upward extending outer surface of protrusion member 6A is flush to and conforms to the rounded inner surface of removable plate cover 4, to facilitate smooth movement of the ratchet gear 6 within housing 2, and to provide a continuous, flat top surface continguous with fitting 13 during use.

A typical line fitting or nut 13 as shown in FIG. 1 is engageable within the hollow defined by inner wall 9 of ratchet gear 6. The body of ratchet gear 6 extends around and above the hollow for holding the line fitting 13.

In the drawings, the multi-sided, hollow opening shown in gear 6 conforms in an octagon shape for eight-sided line fittings 13. For example, as shown in the preferred embodiment shown in FIGS. 2 and 3, the opening D between opening surfaces 8 and 8A is substantially narrower than the opening D' between inner walls 9 and 9' grasping nut or fitting 13. As a result, obliquely extending wall 9" extends between inner wall 9' and parallel opening surface 8, and obliquely extending wall 9''' extends between inner wall 9 and opening surface 8A. Therefore, oblique walls 9" and 9''' provide additional surfaces to engage nut or fitting 13, resulting in more secure gripping of nut or fitting 13. Such a configuration is preferable to that shown in FIG. 1, where the opening is equal to the inner diameter, because less surfaces of nut 13 are engaged and grasped in the device shown in FIG. 1. It is to be understood that the opening can have a different shapes as well to reciprocate and engage variously shaped line fittings or nuts. For example, for a six sided hexagon nut or fitting 13' line wrench tool 1' having housing 2' and similar parallel opening surfaces 28 and 28A, as well as inner surface walls 29 and 29', the distance d between parallel opening surfaces 28 and 28A is substantially less than distance d' extending between the widest points on inner walls 29 and 29'. As a result, obliquely extending wall 9''' extends obliquely between inner wall 29 and opening surface 28A, and obliquely extending wall 29" extends obliquely between inner wall 29' and opening surface 28. Therefore, oblique walls 29" and 29''' provide additional surfaces to engage nut or fittings, resulting in more secure gripping of nut or fitting 13'. Such a configuration is preferable to that shown in FIG. 1, wherein the opening is equal to the inner diameter, because less surfaces of nut. 13' are engaged and grasped in the device shown in FIG. 1.

The ratchet line wrench tool 1 only has to be placed once upon the line fitting 4. Unlike prior art devices which require constant removal and retightening, the ratchet gear 6 holds the tool in place and is moved by a stroke of the handle 3 acting as a lever against fitting 13. The ratchet line wrench tool 1 is designed for use generally on tubing fittings such as fitting 13 shown in FIG. 1.

While the invention incorporates the feature of a ratchet arrangement, unlike conventional wrench devices, the ratchet line wrench tool 1 need not be slipped back from the nut 2, rotated backwards, and re-engaged on the nut to make another partial turn of the nut for tightening. The addition of the ratchet gear 6 within the housing 2 allows the wrench to click backward and to resume the tightening or loosening of the fitting nut 13 on the forward stroke of handle 3. The gear 6 is held in place by the interlocking of teeth 7 with teeth 10 of dog gear 19.

It is noted that the spring 11 firmly holds the dog gear 19 in place so that the teeth 10 of the dog gear 9 can closely engage the gear teeth 7 of ratchet gear 6. The gear teeth elements 7 are received within the recesses formed by the teeth 10 of the dog gear 19. The ratchet gear 6 is moved upward and downward by manual movement into an engageable position from which it is withdrawn for loosening.

Thumb slide pivot lock 12 has a tooth-like head 14 which engages a tooth 7 of ratchet gear 6, thereby repositioning the gear 6 to conform to the opening of wrench housing 2 when changing a gear with one shaped opening such as an octagon to another gear with a different shaped opening, such as a hexagon. The teeth 10 of dog gear 19 prevent the ratchet gear 6 from moving in a counterclockwise direction, as shown in FIG. 3. However, by virtue of the sliding nature of teeth 7 of gear 6 against the teeth 10 of dog gear 19, the ratchet gear 6 is free to rotate in a clockwise direction when the manual stroke of handle 3 so indicates.

Figure 5:
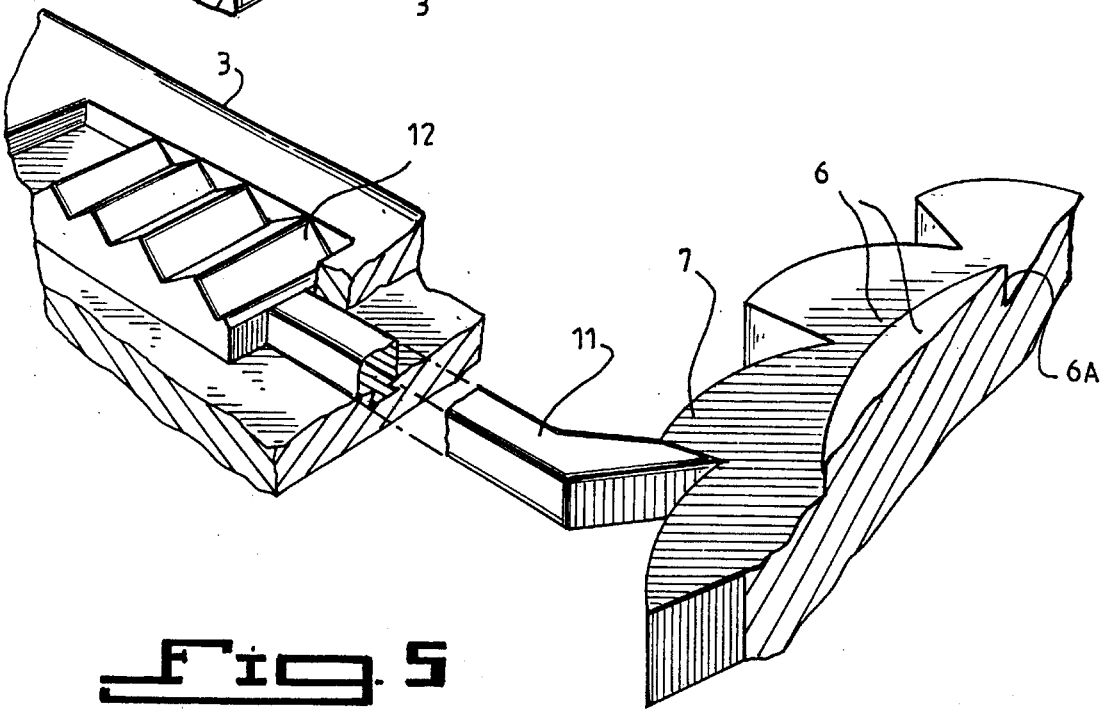
FIG. 5 is a close-up view in partial section showing the pivot locking portion of the invention.

FIG. 2 illustrates the housing portion of the wrench, showing the hollow defined by the inner walls 9 of the ratchet gear 6 for engagement upon a line tool fitting 13. Cover 4 is mounted upon the top portion of the housing 2. With reference to FIGS. 4 and 5, the thumb slide pivot lock 12 is reciprocally engaged out of position so as to engage the locking head 14 with one of the teeth 7 of ratchet gear 6 of the device when moving ratchet gear 6 into the desired position within housing 2.

The above described ratchet line wrench tool can be used, for example, for tightening a fitting or bolt 13 about a line tubing without having to constantly either remove the entire wrench, as in a fixed head wrench, during tightening strokes or by loosening and tightening the jaw portion of the housing in between strokes.

It is however understood that the ratchet line wrench tool of the invention can be used for other purposes as well.

The invention is not limited to the details shown since various modifications and structural changes are possible without departing in any way from the spirit of the present invention.

What is desired to be protected by Letters Patent is set forth in the appended claims.

I claim:

1. A ratchet line wrench tool, comprising a hollow generally circular C-shaped housing portion having an inner hollow portion, said inner hollow portion enclosing a generally C-shaped ratchet gear, said ratchet gear having an inner surface with a multi-faced wall, said multi-faced wall having a first predetermined diameter extending therein, said multi-faced wall conforming in shape to an exterior wall of a fitting to be tightened, said housing portion of said tool having an open mouth for accommodating an elongated tube line having a nut to be tightened or loosened therein, said opening mouth having a second predetermined diameter substantially narrower than said first predetermined diameter of said multi-faced wall of said inner surface of said ratchet gear, said ratchet gear having a plurality of interlocking teeth portions along an outer surface of said ratchet gear on the opposite side of said ratchet gear to said inner surface of said ratchet gear, said interlocking teeth portions contacting and normally being engagable adjacent against corresponding further interlocking teeth portions of a plurality of oppositely faced arcuately extending non-rotatable dog gears located within said hollow C-shaped housing and extending adjacent to an inner edge of said hollow C-shaped housing portion between said ratchet gear and an inner edge of an exterior wall of said C-shaped housing portion, said interlocking teeth of each of said arcuately extending non-rotatable dog gears normally contacting and being engagable adjacent against said interlocking teeth of said ratchet gear by a leaf spring located between and extending substantially arcuately parallel to each of said arcuately extending non-rotatable dog gear and said inner edge of said exterior wall of said housing portion;

a generally C-shaped upward extending protrusion member extending upward from and being integral with a top plan surface of said ratchet gear along an axis perpendicular to said top plan surface of said ratchet gear, said protrusion member having a multi-faced inner surface conforming to and meeting flush with said multi-faced wall of said inner surface of said ratchet gear;

said generally C-shaped upward extending protrusion member having a rounded exterior wall flush with and conforming to a rounded inner surface of a generally C-shaped top plate of said housing to facilitate the rotational movement of said ratchet gear within said housing while maintaining a continuous flat top surface of said wrench tool; and thumb slide lock means slidably engagable with said ratchet gear for positioning said ratchet gear in contact with said dog gear.

* * * * *

UNITED STATES PATENT AND TRADEMARK OFFICE

CERTIFICATE OF CORRECTION

PATENT NO. : 5,454,283

DATED : October 3, 1995

INVENTOR(S) : Jerry Di Stefano

It is certified that error appears in the above-indentified patent and that said Letters Patent is hereby corrected as shown below:

On the title page, under item [19], change "Stefano" to --Di Stefano-- and item [76], change "D. Stefano" to --Di Stefano--.

Signed and Sealed this

Twenty-fourth Day of September, 1996

*Attest:*

*Attesting Officer*

BRUCE LEHMAN

*Commissioner of Patents and Trademarks*